US007511006B2

(12) United States Patent
Shimmin et al.

(10) Patent No.: US 7,511,006 B2
(45) **Date of Patent: *Mar. 31, 2009**

(54) LOW RESIDUE CLEANING SOLUTION COMPRISING A C8 TO C10 ALKYLPOLYGLUCOSIDE AND GLYCEROL

(75) Inventors: Laura Shimmin, Oakland, CA (US); Sonia H. Burciaga, Tracy, CA (US); Bernard Hill, San Francisco, CA (US); Ryan K. Hood, Dublin, CA (US); Thomas W. Kaaret, Alamo, CA (US); Andrew Kilkenny, Livermore, CA (US); Stephen Bradford Kong, Alamo, CA (US)

(73) Assignee: The Clorox Company, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/141,583

(22) Filed: Jun. 18, 2008

(65) Prior Publication Data

US 2008/0255023 A1 Oct. 16, 2008

Related U.S. Application Data

(63) Continuation-in-part of application No. 11/780,056, filed on Jul. 19, 2007, now Pat. No. 7,414,017, and a continuation-in-part of application No. 11/612,672, filed on Dec. 19, 2006, now Pat. No. 7,345,015, and a continuation-in-part of application No. 09/939,383, filed on Aug. 24, 2001, now abandoned, and a continuation-in-part of application No. 09/939,179, filed on Aug. 24, 2001, now abandoned, which is a continuation-in-part of application No. 09/737,641, filed on Dec. 14, 2000, now abandoned.

(51) Int. Cl.
*C11D 3/22* (2006.01)
*C11D 3/44* (2006.01)

(52) U.S. Cl. ..... 510/295; 510/238; 510/253; 510/362; 510/382; 510/384; 510/432; 510/438; 510/470; 510/391

(58) Field of Classification Search ..... 510/295, 510/238, 362, 382, 384, 391, 432, 438, 470, 510/253
See application file for complete search history.

(56) References Cited

U.S. PATENT DOCUMENTS 4,753,844 A 6/1988 Jones et al.
5,342,534 A * 8/1994 Skrobala et al. ..... 15/104.93
5,525,256 A * 6/1996 Morris et al. ..... 510/435
5,576,284 A * 11/1996 van Buskirk et al. ..... 510/384
5,776,882 A * 7/1998 Vasudevan ..... 510/434
5,780,416 A * 7/1998 Kiewert et al. ..... 510/422
5,856,290 A * 1/1999 van Buskirk et al. ..... 510/382
6,159,916 A * 12/2000 Robbins et al. ..... 510/238
6,159,924 A * 12/2000 Weller et al. ..... 510/384
6,251,849 B1 * 6/2001 Jeschke et al. ..... 510/470
6,336,977 B1 * 1/2002 Menke et al. ..... 134/42
6,384,010 B1 5/2002 Wagers
6,489,285 B2 12/2002 Faber
6,521,578 B1 * 2/2003 Stute et al. ..... 510/238
6,624,182 B1 * 9/2003 Haap et al. ..... 514/365
6,642,197 B1 11/2003 Cheung et al.
6,716,805 B1 4/2004 Sherry et al.
6,743,819 B1 6/2004 Manzer
6,749,645 B2 * 6/2004 Pasquier et al. ..... 8/405
6,786,223 B2 9/2004 Klinkhammer et al.
6,794,346 B2 9/2004 Wick et al.
6,797,399 B2 * 9/2004 Weuthen et al. ..... 428/532
6,814,088 B2 11/2004 Barnabas et al.
6,818,593 B2 * 11/2004 Manzer ..... 504/283
6,841,527 B2 1/2005 Mitra et al.
6,849,589 B2 2/2005 Liu
6,908,492 B2 * 6/2005 Umbricht et al. ..... 8/405
6,936,580 B2 8/2005 Sherry et al.
7,048,806 B2 5/2006 Ochomogo et al.
7,082,951 B2 8/2006 Barnabas et al.
7,094,741 B2 8/2006 Barnabas et al.
7,202,200 B1 * 4/2007 DeLeo et al. ..... 510/191
7,345,015 B1 * 3/2008 Kong et al. ..... 510/295
7,396,808 B1 * 7/2008 Hood et al. ..... 510/474
7,414,017 B2 * 8/2008 Kong et al. ..... 510/295
2002/0108640 A1 * 8/2002 Barger et al. ..... 134/26
2002/0119902 A1 * 8/2002 Harrison et al. ..... 510/424
2003/0100465 A1 5/2003 Kilkenny et al.
2003/0175217 A1 * 9/2003 Kropf et al. ..... 424/49
2003/0216281 A1 11/2003 DeLeo et al.
2004/0068782 A1 * 4/2004 Butter-Jentsch et al. ..... 4/231
2004/0192932 A1 * 9/2004 Manzer ..... 548/552
2005/0121054 A1 6/2005 Barnabas et al.
2006/0293214 A1 * 12/2006 Cheng et al. ..... 510/504
2007/0000069 A1 * 1/2007 Schmenger et al. ..... 8/405
2007/0264293 A1 * 11/2007 Elder et al. ..... 424/401
2008/0021098 A1 * 1/2008 McGee et al. ..... 514/462

* cited by examiner

*Primary Examiner*—Charles I Boyer
(74) *Attorney, Agent, or Firm*—Alok Goel

(57) ABSTRACT

The present invention relates to cleaning compositions containing C8-C10 alkylpolyglucosides which have low filming and streaking when combined with C2-C4 alcohols. The cleaning compositions can optionally comprise dyes, builders, fatty acids, fragrances, colorants, glycerol, anti-foaming agents, and preservatives.

14 Claims, No Drawings

LOW RESIDUE CLEANING SOLUTION COMPRISING A C8 TO C10 ALKYLPOLYGLUCOSIDE AND GLYCEROL

The present invention is a continuation-in-part of U.S. patent application Ser. No. 11/780,056, filed Jul. 19, 2007 now U.S. Pat. No. 7,414,017 entitled "Low Residue Cleaning Solution," and is incorporated herein by reference. The present invention is a continuation-in-part of U.S. patent application Ser. No. 11/612,672 filed Dec. 19, 2006 now U.S. Pat. No. 7,345,015 entitled "Low Residue Cleaning Solution for Disinfecting Wipes," and is incorporated herein by reference. The present invention is also a continuation-in-part of U.S. patent application Ser. No. 09/939,383 filed Aug. 24, 2001 now abandoned entitled "Bactericidal Cleaning Wipe," and is incorporated herein by reference. The present invention is also a continuation-in-part of U.S. patent application Ser. No. 09/939,179 filed Aug. 24, 2001 now abandoned entitled "Bactericidal Cleaning Wipe," which in turn is a continuation-in-part of U.S. patent application Ser. No. 09/737,641 filed Dec. 14, 2000 now abandoned entitled "Bactericidal Cleaning Wipe." U.S. patent application Ser. Nos. 09/939,179 filed Aug. 24, 2001 and 09/737,641 filed Dec. 14, 2000 are incorporated herein by reference.

BACKGROUND OF THE INVENTION

1. Field of the Invention

The present invention relates generally to a composition for reducing residue left by wet cleaning substrates used for cleaning hard surfaces, such as a kitchen, bathroom or other hard surface.

2. Description of the Related Art

When cleaning wipes are impregnated with cleaning compositions containing cationic biocides for disinfection, the cleaning operation typically leaves a residue on glossy surfaces. This may be the case because the saturated wipes leave substantial liquid on the surface. When using a spray cleaner, the residue problems are reduced since the consumer typically wipes off the spray cleaner with a dry paper towel. It is the combination of the cleaning substrate saturated with the cleaning composition that makes it difficult to leave a surface free from filming and streaking.

U.S. Pat. Nos. 6,936,580 and 6,716,805 to Sherry et al discloses alkylpolyglucosides with hydrophilic polymers and propylene glycol propylether on nonwoven substrates. U.S. Pat. No. 4,753,844 to Jones et al. discloses alkylpolyglucosides, ethanol, and isopropanol on nonwoven substrates. U.S. Pat. No. 5,342,534 to Skrobala et al. discloses alkylpolyglucosides and ethanol on nonwoven substrates. U.S. Pat. Pub. No. 2005/0121054, and U.S. Pat. No. 7,082,951 to Barnabas et al. discloses alkylpolyglucosides with citric acid and PHMB.

The present invention surprisingly has found a cleaning composition containing a C8 to C10 alkylpolyglucoside and a C2 to C4 alcohol that is absorbed onto a nonwoven substrate provides surface disinfection with low residue (low filming and streaking) and low foaming during use. The low foam translates to lower filming and streaking and thus significantly improves consumer acceptability for a disinfecting wipe. While not intending to be bound by theory, the premise for achieving low filming and streaking is to have a cleaning composition that does not bead up (i.e., having no increase in contact angle as the composition dries). The choice of surfactant and solvent significantly affects the properties of the formulation as it dries. Most quat based disinfecting wipes products leave significant residue that is particularly noticeable on smooth glossy surfaces. The inventive formulation provides surface disinfection and cleaning while providing low foaming and low residue (i.e. low filming and streaking), thus eliminating the need of a follow up wiping step. The problems associated with residue left after cleaning with wet substrates of the prior art can be avoided by the low residue compositions of the present invention. It is therefore an object of the present invention to provide an antimicrobial cleaning composition in a cleaning substrate that overcomes the disadvantages and shortcomings associated with prior art examples.

SUMMARY OF THE INVENTION

In accordance with the above objects and those that will be mentioned and will become apparent below, one aspect of the present invention comprises a hard surface cleaning composition comprising 0.1 to 5.0 weight % of a C8 to C10 alkylpolyglucoside wherein the alkyl group is substantially C8 alkyl, substantially C10 alkyl, or a mixture of substantially C8 and C10 alkyl; 0.5 to 5.0 weight % of a C2 to C4 alcohol or combination of C2 to C4 alcohols; and optionally dyes, builders, fatty acids, fragrances, colorants, glycerol, anti-foaming agent, water-soluble organic acid, and preservatives.

In accordance with the above objects and those that will be mentioned and will become apparent below, another aspect of the present invention comprises a hard surface cleaning composition comprising 0.1 to 5.0 weight % of a C8 to C10 alkylpolyglucoside wherein the alkyl group is substantially C8 alkyl, substantially C10 alkyl, or a mixture of substantially C8 and C10 alkyl; 0.5 to 5.0 weight % of a C2 to C4 alcohol or combination of C2 to C4 alcohols; 0.05 to 2.0 weight % of glycerol; and optionally dyes, builders, fatty acids, fragrances, colorants, anti-foaming agent, water-soluble organic acid, and preservatives.

In accordance with the above objects and those that will be mentioned and will become apparent below, another aspect of the present invention comprises a hard surface cleaning composition comprising 0.1 to 5.0 weight % of a C8 to C10 alkylpolyglucoside wherein the alkyl group is substantially C8 alkyl, substantially C10 alkyl, or a mixture of substantially C8 and C10 alkyl; 0.5 to 5.0 weight % of a C2 to C4 alcohol or combination of C2 to C4 alcohols; 0.01 to 5.0 weight % of a water-soluble organic acid; and optionally dyes, builders, fatty acids, fragrances, colorants, anti-foaming agent, water-soluble organic acid, glycerol and preservatives.

Further features and advantages of the present invention will become apparent to those of ordinary skill in the art in view of the detailed description of preferred embodiments below, when considered together with the attached claims.

DETAILED DESCRIPTION OF THE INVENTION

Before describing the present invention in detail, it is to be understood that this invention is not limited to particularly exemplified systems or process parameters that may, of course, vary. It is also to be understood that the terminology used herein is for the purpose of describing particular embodiments of the invention only, and is not intended to limit the scope of the invention in any manner.

All publications, patents and patent applications cited herein, whether supra or infra, are hereby incorporated by reference in their entirety to the same extent as if each individual publication, patent or patent application was specifically and individually indicated to be incorporated by reference.

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

The cleaning substrate can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

In the application, effective amounts are generally those amounts listed as the ranges or levels of ingredients in the descriptions, which follow hereto. Unless otherwise stated, amounts listed in percentage ("%'s") are in weight percent (based on 100% active) of the cleaning composition alone, not accounting for the substrate weight. Each of the noted cleaner composition components and substrates is discussed in detail below.

As used herein, the term "substrate" is intended to include any material that is used to clean an article or a surface. Examples of cleaning substrates include, but are not limited to nonwovens, sponges, films and similar materials, which can be attached to a cleaning implement, such as a toilet cleaning device. As used herein, "disposable" is used in its ordinary sense to mean an article that is disposed or discarded after a limited number of usage events, preferably less than 25, more preferably less than about 10, and most preferably less than about 2 entire usage events.

As used herein, "wiping" refers to any shearing action that the substrate undergoes while in contact with a target surface. This includes hand or body motion, substrate-implement motion over a surface, or any perturbation of the substrate via energy sources such as ultrasound, mechanical vibration, electromagnetism, and so forth.

As used herein, the terms "nonwoven" or "nonwoven web" means a web having a structure of individual fibers or threads which are interlaid, but not in an identifiable manner as in a knitted web. Nonwoven webs have been formed from many processes, such as, for example, meltblowing processes, spunbonding processes, and bonded carded web processes.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "sponge", as used herein, is meant to mean an elastic, porous material, including, but not limited to, compressed sponges, cellulosic sponges, reconstituted cellulosic sponges, cellulosic materials, foams from high internal phase emulsions, such as those disclosed in U.S. Pat. No. 6,525,106, polyethylene, polypropylene, polyvinyl alcohol, polyurethane, polyether, and polyester sponges, foams and nonwoven materials, and mixtures thereof.

The term "cleaning composition", as used herein, is meant to mean and include a cleaning formulation having at least one surfactant.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic and/or amphoteric agents.

The term "comprising", which is synonymous with "including," "containing," or "characterized by," is inclusive or open-ended and does not exclude additional, unrecited elements or method steps. See MPEP 2111.03. See, e.g., *Mars Inc.* v. *H.J. Heinz Co.,* 377 F.3d 1369, 1376, 71 USPQ2d 1837, 1843 (Fed. Cir. 2004) ("like the term 'comprising,' the terms 'containing' and 'mixture' are open-ended."). *Invitrogen Corp. v. Biocrest Mfg., L.P.,* 327 F.3d 1364, 1368, 66 USPQ2d 1631, 1634 (Fed. Cir. 2003) ("The transition 'comprising' in a method claim indicates that the claim is open-ended and allows for additional steps."); *Genentech, Inc. v. Chiron Corp.,* 112 F.3d 495, 501, 42 USPQ2d 1608, 1613 (Fed. Cir. 1997) See MPEP 2111.03. ("Comprising" is a term of art used in claim language which means that the named elements are essential, but other elements may be added and still form a construct within the scope of the claim.); *Moleculon Research Corp. v. CBS, Inc.,* 793 F.2d 1261, 229 USPQ 805 (Fed. Cir. 1986); *In re Baxter,* 656 F.2d 679, 686, 210 USPQ 795, 803 (CCPA 1981); *Ex parte Davis,* 80 USPQ 448, 450 (Bd. App. 1948). See MPEP 2111.03.

The term "consisting essentially of" as used herein, limits the scope of a claim to the specified materials or steps "and those that do not materially affect the basic and novel characteristic(s)" of the claimed invention. In re Herz, 537 F.2d 549, 551-52, 190 USPQ 461, 463 (CCPA 1976) (emphasis in original). See MPEP 2111.

Alkylpolyglucosides

Suitable non-ionic low residue surfactants are the alkylpolysaccharides that are disclosed in U.S. Pat. No. 5,776,872 to Giret et al.; U.S. Pat. No. 5,883,059 to Furman et al.; U.S. Pat. No. 5,883,062 to Addison et al.; and U.S. Pat. No. 5,906,973 to Ouzounis et al. Suitable alkyl polyglucosides for use herein are also disclosed in U.S. Pat. No. 4,565,647 to Llenado describing alkylpolyglucosides having a hydrophobic group containing from about 6 to about 30 carbon atoms, or from about 10 to about 16 carbon atoms and polysaccharide, e.g. , a polyglycoside, hydrophilic group containing from about 1.3 to about 10, or from about 1.3 to about 3, or from about 1.3 to about 2.7 saccharide units. Optionally, there can be a polyalkyleneoxide chain joining the hydrophobic moiety and the polysaccharide moiety. A suitable alkyleneoxide is ethylene oxide. Typical hydrophobic groups include alkyl groups, either saturated or unsaturated, branched or unbranched containing from about 8 to about 18, or from about 10 to about 16, carbon atoms. Suitably, the alkyl group can contain up to about 3 hydroxy groups and/or the polyalkyleneoxide chain can contain up to about 10, or less than about 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

Suitable alkylpolyglycosides (or alkylpolyglucosides) have the formula:

$$R^2O(C_nH_{2n}O)_t(\text{glucosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is about 2 or about 3, preferably about 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1-position and the preceding glycosyl units 2-, 3-, 4-and/or 6-position, preferably predominantly the 2-position.

A group of alkyl glycoside surfactants suitable for use in the practice of this invention may be represented by Formula I below:

$$RO—(R^2O)_y—(G)_xZ_b \qquad \text{Formula I}$$

wherein R is a monovalent organic radical containing from about 6 to about 30 (preferably from about 8 to about 18) carbon atoms; $R^2$ is a divalent hydrocarbon radical containing from about 2 to about 4 carbon atoms; O is an oxygen atom; y is a number which has an average value from about 0 to about 1 and is preferably 0; G is a moiety derived from a reducing saccharide containing 5 or 6 carbon atoms; and x is a number having an average value from about 1 to 5 (preferably from 1.1 to 2); Z is $O_2M^1$, $O_2CR^3$, $O(CH_2)$, $CO_2M^1$, $OSO_3M^1$, or $O(CH_2)SO_3M^1$; $R^3$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a $—CO_2M^1$ group); b is a number from 0 to 3x+1 preferably an average of from 0.5 to 2 per glycosal group; p is 1 to 10, $M^1$ is $H^+$ or an organic or inorganic cation, such as, for example, an alkali metal, ammonium, monoethanolamine, or calcium. As defined in Formula I, R is generally the residue of a fatty alcohol having from about 8 to 30 or 8 to 18 carbon atoms. Suitable alkylglycosides include, for example, Glucopon® 215 (a $C_8$-$C_{10}$ alkyl polyglucoside available from Cognis Corporation), APG 325® (a $C_9$-$C_{11}$ alkyl polyglycoside available from Cognis Corporation), APG 625® (a $C_{10}$-$C_{16}$ alkyl polyglycoside available from Cognis Corporation), Dow Triton® CG110 (a $C_8$-$C_{10}$ alkyl polyglycoside available from Dow Chemical Company), AG6202® (a $C_8$ alkyl polyglycoside available from Akzo Nobel) and Alkadet 15® (a $C_8$-$C_{10}$ alkyl polyglycoside available from Huntsman Corporation). A C8 to C10 alkylpolyglucoside includes alkylpolyglucosides wherein the alkyl group is substantially C8 alkyl, substantially C10 alkyl, or a mixture of substantially C8 and C10 alkyl. The C8 to C10 alkylpolyglucoside contains substantially no C9 alkyl or C11 alkyl groups. Suitably, the alkyl polyglycoside is present in the liquid cleaning composition in an amount ranging from about 0.01 to about 5 weight percent, or 0.1 to 5.0 weight percent, or 0.1 to 4.0 weight percent, 0.1 to 3.0 weight percent, or 0.1 to 2.0 weight percent, 0.1 to 1.0 weight, or 0.1 to 0.5 weight percent.

Additional Surfactants

The cleaning composition may contain one or more additional surfactants selected from anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, anionic, ampholytic, amphotenic and zwitteronic surfactants are generally used in combination with one or more nonionic surfactants. The surfactants may be present at a level of from about 0% to 50%, or from about 0.001% to 10%, or from about 0.1% to 2% by weight, or are absent.

Suitable nonionic surfactants can be found in U.S. Pat. No. 3,929,678 to Laughlin et al. Essentially any alkoxylated nonionic surfactants are suitable herein, for instance, ethoxylated and propoxylated nonionic surfactants. Alkoxylated surfactants can be selected from the classes of the nonionic condensates of alkyl phenols, nonionic ethoxylated alcohols, nonionic ethoxylated/propoxylated fatty alcohols, nonionic ethoxylate/propoxylate condensates with propylene glycol, and the nonionic ethoxylate condensation products with propylene oxide/ethylene diamine adducts. Suitable anionic surfactants include salts (including, for example, sodium, potassium, ammonium, and substituted ammonium salts such as mono-, di- and tri-ethanolamine salts) of the anionic sulfate, sulfonate, carboxylate and sarcosinate surfactants. Anionic surfactants may comprise a sulfonate or a sulfate surfactant. Anionic surfactants may comprise an alkyl sulfate, a linear or branched alkyl benzene sulfonate, or an alkyldiphenyloxide disulfonate, as described herein. Suitable amphoteric surfactants include the amine oxide surfactants and the alkyl amphocarboxylic acids. Suitable amine oxides include those compounds having the formula $R^3(OR^4)_xNO(R^5)_2$ wherein $R^3$ is selected from an alkyl, hydroxyalkyl, acylamidopropyl and alkylphenyl group, or mixtures thereof, containing from 8 to 26 carbon atoms; $R^4$ is an alkylene or hydroxyalkylene group containing from 2 to 3 carbon atoms, or mixtures thereof, x is from 0 to 5, preferably from 0 to 3; and each $R^5$ is an alkyl or hydroxyalkyl group containing from 1 to 3, or a polyethylene oxide group containing from 1 to 3 ethylene oxide groups. Suitable amine oxides are C10-C18 alkyl dimethylamine oxide, and C10-C18 acylamido alkyl dimethylamine oxide. A suitable example of an alkyl amphodicarboxylic acid is Miranol® C2M Conc. Suitable zwitterionic surfactants include betaines having the formula $R(R^1)_2N^+R^2COO^-$ wherein R is a C6-C18 hydrocarbyl group, each $R^1$ is typically C1-C3 alkyl, and $R^2$ is a C1-C5 hydrocarbyl group. Suitable betaines are C12-18 dimethyl-ammonio hexanoate and the C10-C18 acylamidopropane (or ethane) dimethyl (or diethyl) betaines. Suitable cationic surfactants to be used herein include the quaternary ammonium surfactants. The quaternary ammonium surfactant may be a mono C6-C16, or a C6-C10 N-alkyl or alkenyl ammonium surfactant wherein the remaining N positions are substituted by methyl, hydroxyethyl or hydroxypropyl groups. Suitable are also the mono-alkoxylated and bis-alkoxylated amine surfactants.

Solvents

In one aspect of the invention the composition includes volatile solvents that are substantially soluble in water. In one embodiment, combinations of very volatile solvents and slightly volatile solvents are suitable. While not intended to be bound by theory, the very volatile solvents may volatilize off after application and not form multiple phases that can lead to enhanced filming and streaking. The less volatile solvents may maintain phase stability for the nonvolatile components. The very volatile solvent can have a vapor pressure greater than 10 mm Hg at 20° C. The less volatile solvent can have a vapor pressure greater than 0.1 mm Hg and less than 2.0 mm, or greater than 1.0 mm and less than 2.0 mm at 20° C. The solvents should be greater than 5% soluble, or greater than 25% soluble in water. Examples of solvents are listed in Table A. Suitable very volatile solvents include C2 to C4 alcohols, such as ethanol or isopropanol, and are present in from 0.1% to 5.0%, or from 0.1% to 4.0%, or from 0.1% to 1.0%, or from 0.5% to 5.0%, or from 0.5% to 4.0%, or from 0.5% to 3.0%, or from 0.5% to 3.0%, or from 0.1% to 2.0%, or from 0.1% to 3.0%, or from 0.5% to 2.0%, or from 0.5 to 1.0%.

TABLE A

| Solvent | Vapor pressure Mm Hg (20° C.) | Solubility in water (%) | Surface tension dynes/cm (25° C.) | Specific Heat cal/g K (25° C.) |
|---|---|---|---|---|
| Ethanol | 43 | 100 | 22.3 | 0.618 |
| Isopropanol | 33 | 100 | | 0.65 |
| 1,2-Propylene glycol | 0.07 | 100 | 40.1 | 0.590 |

Builder/Buffer

The cleaning composition may include a builder or buffer, which increase the effectiveness of the surfactant. The builder or buffer can also function as a softener and/or a sequestering agent in the cleaning composition. A variety of builders or buffers can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builders or buffers can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builders or buffers can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, hydroxide, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri (hydroxylmethyl) amino methane (TRIS), 2-amino-2-ethyl-1,3-propanediol, 2-amino-2-methylpropanol, 2- amino-2-methyl-1,3-propanol, disodium glutamate, N-methyl diethanolamide, 2-dimethylamino- 2-methylpropanol (DMAMP), 1,3-bis(methyl-amine)cyclohexane, 1,3-diamino-propanol N,N'-tetra-methyl-1,3-diamino-2-propanol, N,N-bis(2-hydroxyethyl)glycine (bicine) and N-tris(hydroxymethyl)methyl glycine (tricine). Other suitable buffers include ammonium carbamate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see WO 95/07971, which is incorporated herein by reference. Other preferred pH adjusting agents include sodium or potassium hydroxide.

When employed, the builder, buffer, or pH adjusting agent comprises at least about 0.001% and typically about 0.01-5%, or 0.1-1% or 0.1-0.5% by weight of the cleaning composition.

Glycerol

The cleaning compositions may optionally contain glycerol, or glycerin. The glycerol may be natural, for example from the saponification of fats in soap manufacture, or synthetic, for example by the oxidation and hydrolysis of allyl alcohol. The glycerol may be crude or highly purified. The glycerol can serve to compatibilize the alkyl polyglucoside, the ethanol and the fragrance (i.e., lemon oil or d-limonene). Proper compatibilization of these components in suitable ratios, such as demonstrated in the examples below, allow these limited components to perform as well as complex formulated conventional synthetic cleaning compositions. Glycerol is an effective way of solubilizing the fragrance at the lower surfactant levels without increasing filming or streaking. Suitably, the glycerol is present in the cleaning composition in an amount ranging from about 0.01 to about 2 weight percent, or 0.05 to 2.0 weight percent, or 0.05 to 1.0 weight percent, or 0.05 to 0.5 weight percent, or 0.05 to 1.0 weight percent, or 0.10 to 2.0 weight percent, or 0.10 to 1.0 weight percent, or 0.10 to 0.5 weight percent.

Organic Acid

The cleaning composition may optionally contain an organic acid. An organic acid is an organic compound with acidic compounds. The most common organic acids include but are not limited to, carboxylic acids and sulfonic acids. Organic acids are weak acids that usually do not completely dissociate in water.

In a preferred embodiment, one aspect of the invention is a 2-hydroxycarboxylic acid or mixture of 2-hydroxycarboxylic acids. Examples of 2-hydroxycarboxylic acids include, but are not limited to, tartaric acid, citric acid, malic acid, mandelic acid, oxalic acid, glycolic acid, and lactic acid. 2-Hydroxycarboxylic acids also include polymeric forms of 2-hydroxycarboxylic acid, such as polylactic acid. Since other organic builders are not substantially present, significant amounts of 2-hydroxycarboxylic acids are required. Suitable compositions comprise 2-hydroxycarboxylic acids in concentrations of 0.01 to 50% by weight, or 0.01 to 20% by weight, or 0.01 to 10% by weight, or 0.01 to 5.0% by weight, or 0.01 to 4.0% by weight, or 0.01 to 3.0% by weight, or 0.01 to 2.0% by weight, or 0.01 to 1.0% by weight, or 0.01 to 0.5% by weight or 0.01 to 0.1% by weight, or 0.01 to 0.05% by weight, or 0.001 to 1.0% by weight.

Fatty Acids

The cleaning composition can optionally contain fatty acids. A fatty acid is a carboxylic acid that is often with a long unbranched aliphatic tail (chain), which is saturated or unsaturated. Fatty acids are aliphatic monocarboxylic acids, derived from, or contained in esterified form in an animal or vegetable fat, oil or wax. Natural fatty acids commonly have a chain of 4 to 28 carbons (usually unbranched and even numbered), which may be saturated or unsaturated. Saturated fatty acids do not contain any double bonds or other functional groups along the chain. The term "saturated" refers to hydrogen, in that all carbons (apart from the carboxylic acid [—COOH] group) contain as many hydrogens as possible. In contrast to saturated fatty acids, unsaturated fatty acids contain double bonds. Examples of fatty acids that can be used in the present invention, include but are not limited to, butyric acid, caproic acid, caprylic acid, capric acid, lauric acid, myristic acid, palmitic acid, stearic acid, arachdic acid, behenic acid, lignoceric acid, myristoleic acid, palmitoleic acid, oleic acid, linoleic acid, alpha-linoleic acid, arachidonic acid, eicosapentaenoic acid, erucic acid, docosahexaenoic acid or mixtures thereof. Suitably, fatty acids are present in the cleaning composition in an amount ranging from about 0.01 to about 1.0 weight percent, 0.01 to about 0.50 weight percent, or 0.01 to 0.40 weight percent, or 0.01 to 0.30 weight percent, or 0.01 to 0.25 weight percent, or 0.01 to 0.20 weight percent, or 0.01 to 0.10 weight percent, or 0.05 to 0.40 weight percent, or 0.05 to 0.30 weight percent, or 0.04 to 0.25 weight percent, or 0.04 to 0.20 weight percent, or 0.04 to 0.10 weight percent.

Additional Adjuncts

The cleaning compositions optionally contain one or more of the following adjuncts: stain and soil repellants, lubricants, odor control agents, anti-foaming agent, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Electrolytes, when used, include, calcium, sodium and potassium chloride. Thickeners, when used, include, but are not limited to, polyacrylic acid, xanthan gum, calcium carbonate, aluminum oxide, alginates, guar gum, clays, methyl, ethyl, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide. An exemplary anti-foaming agent is an organofunctional silicone antifoam, such as DSP Anti-Foam, manufactured by Dow Corning Corporation.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®) and/or short chain alcohols (e.g. ethanol and/or IPA). The mildewstat or bacteriostat includes, but is not limited to, mildewstats (including non-isothiazolone compounds) include Kathon GC®, a 5-chloro-2-methyl-4-isothiazolin-3-one, KATHON ICP®, a 2-methyl-4-isothiazolin-3-one, and a blend thereof, and KATHON 886®, a 5-chloro-2-methyl-4-isothiazolin-3-one, all available from Rohm and Haas Company; BRONOPOL®, a 2-bromo-2-nitropropane 1,3 diol, from Boots Company Ltd., PROXEL CRL®, a propyl-p-hydroxybenzoate, from ICI PLC; NIPASOL M®, an o-phenyl-phenol, $Na^+$ salt, from Nipa Laboratories Ltd., DOWICIDE A®, a 1,2-Benzoisothiazolin-3-one, from Dow Chemical Co., and IRGASAN DP 200®, a 2,4,4'-trichloro-2-hydroxydiphenylether, from Ciba-Geigy A.G.

Water

When the composition is an aqueous composition, water can be, along with the solvent, a predominant ingredient. The water can be present at a level of less than 99.9%, or less than about 99%, or less than about 95%. The water can be tap water, soft water, or deionized water. Where the cleaning composition is concentrated, the water may be present in the composition at a concentration of less than about 85 wt. %.

The composition of the cleaning composition of the present invention can have a range of pHs. In one embodiment, the pH of the cleaning composition has a pH of 10.0 or less, 9.0 or less, or 8.0 or less, or 7.0 or less, or 6.0 or less, or 5.0 or less or 4.0 or less. In another embodiment, the pH of the cleaning composition has a pH of between 6.0 and 10.0, or 6.0 and 8.0, or 6.0 and 9.0, or 5.0 and 9.0, or 4.0 and 9.0, or 4.5 and 8.5, or 5.5 and 8.5, or 5.5 and 7.5, or 6.5 and 8.5 or 7.5 and 8.5.

Substrate

The cleaning composition may be part of a cleaning substrate. A wide variety of materials can be used as the cleaning substrate. The substrate should have sufficient wet strength, abrasivity, loft and porosity. Examples of suitable substrates include, nonwoven substrates, wovens substrates, hydroentangled substrates, foams and sponges. Any of these substrates may be water-insoluble, water-dispersible, or water-soluble. In one embodiment, the wipe weight is between 1 and 300 gsm, 1 and 200 gsm, 1 and 100 gsm, 10 and 100 gsm, 25 and 75 gsm, 40 and 60 gsm and 50 and 60 gsm.

In one embodiment, the cleaning pad of the present invention comprises a nonwoven substrate or web. The substrate is composed of nonwoven fibers or paper. The term nonwoven is to be defined according to the commonly known definition provided by the "Nonwoven Fabrics Handbook" published by the Association of the Nonwoven Fabric Industry. A paper substrate is defined by EDANA (note 1 of ISO 9092-EN 29092) as a substrate comprising more than 50% by mass of its fibrous content is made up of fibers (excluding chemically digested vegetable fibers) with a length to diameter ratio of greater than 300, and more preferably also has density of less than 0.040 $g/cm^3$. The definitions of both nonwoven and paper substrates do not include woven fabric or cloth or sponge. The substrate can be partially or fully permeable to water. The substrate can be flexible and the substrate can be resilient, meaning that once applied external pressure has been removed the substrate regains its original shape.

Methods of making nonwovens are well known in the art. Generally, these nonwovens can be made by air-laying, water-laying, meltblowing, coforming, spunbonding, or carding processes in which the fibers or filaments are first cut to desired lengths from long strands, passed into a water or air stream, and then deposited onto a screen through which the fiber- laden air or water is passed. The air-laying process is described in U.S. Pat. Pub. No. 2003/0036741 to Abba et al. and U.S. Pat. Pub. No. 2003/0118825 to Melius et al. The resulting layer, regardless of its method of production or composition, is then subjected to at least one of several types of bonding operations to anchor the individual fibers together to form a self-sustaining substrate. In the present invention the nonwoven substrate can be prepared by a variety of processes including, but not limited to, air-entanglement, hydroentanglement, thermal bonding, and combinations of these processes.

Additionally, the first layer and the second layer, as well as additional layers, when present, can be bonded to one another in order to maintain the integrity of the article. The layers can be heat spot bonded together or using heat generated by ultrasonic sound waves. The bonding may be arranged such that geometric shapes and patterns, e.g. diamonds, circles, squares, etc. are created on the exterior surfaces of the layers and the resulting article.

The cleaning substrates can be provided dry, pre-moistened, or impregnated with cleaning composition, but dry-to-the-touch. In one aspect, dry cleaning substrates can be provided with dry or substantially dry cleaning or disinfecting agents coated on or in the multicomponent multilobal fiber layer. In addition, the cleaning substrates can be provided in a pre-moistened and/or saturated condition. The wet cleaning substrates can be maintained over time in a sealable container such as, for example, within a bucket with an attachable lid, sealable plastic pouches or bags, canisters, jars, tubs and so forth. Desirably the wet, stacked cleaning substrates are maintained in a resealable container. The use of a resealable container is particularly desirable when using volatile liquid compositions since substantial amounts of liquid can evaporate while using the first substrates thereby leaving the remaining substrates with little or no liquid. Exemplary resealable containers and dispensers include, but are not limited to, those described in U.S. Pat. No. 4,171,047 to Doyle et al., U.S. Pat. No. 4,353,480 to McFadyen, U.S. Pat. No. 4,778,048 to Kaspar et al., U.S. Pat. No. 4,741,944 to Jackson et al., U.S. Pat. No. 5,595,786 to McBride et al.; the entire contents of each of the aforesaid references are incorporated herein by reference. The cleaning substrates can be incorporated or oriented in the container as desired and/or folded as desired in order to improve ease of use or removal as is known in the art. The cleaning substrates of the present invention can be provided in a kit form, wherein a plurality of cleaning substrates and a cleaning tool are provided in a single package.

The substrate can include both natural and synthetic fibers. The substrate can also include water-soluble fibers or water-dispersible fibers, from polymers described herein. The substrate can be composed of suitable unmodified and/or modified naturally occurring fibers including cotton, Esparto grass, bagasse, hemp, flax, silk, wool, wood pulp, chemically modified wood pulp, jute, ethyl cellulose, and/or cellulose acetate. Various pulp fibers can be utilized including, but not limited to, thermomechanical pulp fibers, chemi-thermomechanical pulp fibers, chemi-mechanical pulp fibers, refiner mechanical pulp fibers, stone groundwood pulp fibers, peroxide mechanical pulp fibers and so forth. In some embodiments, the ratio of the lyocell to wood fibers can be 40% lyocell, 60% wood fibers; 50% lyocell, 50% wood fibers, 60% lyocell and 40% wood fibers, 70% lyocell and 30% wood fibers.

Suitable synthetic fibers can comprise fibers of one, or more, of polyvinyl chloride, polyvinyl fluoride, polytetrafluoroethylene, polyvinylidene chloride, polyacrylics such as ORLON®, polyvinyl acetate, Rayon®, polyethylvinyl acetate, non-soluble or soluble polyvinyl alcohol, polyolefins such as polyethylene (e.g., PULPEX®) and polypropylene, polyamides such as nylon, polyesters such as DACRON® or KODEL®, polyurethanes, polystyrenes, and the like, including fibers comprising polymers containing more than one monomer.

The cleaning substrate of this invention may be a multilayer laminate and may be formed by a number of different techniques including but not limited to using adhesive, needle punching, ultrasonic bonding, thermal calendering and through-air bonding. Such a multilayer laminate may be an embodiment wherein some of the layers are spunbond and some meltblown such as a spunbond/meltblown/spunbond (SMS) laminate as disclosed in U.S. Pat. No. 4,041,203 to Brock et al. and U.S. Pat. No. 5,169,706 to Collier, et al., each hereby incorporated by reference. The SMS laminate may be made by sequentially depositing onto a moving conveyor belt or forming wire first a spunbond web layer, then a meltblown web layer and last another spunbond layer and then bonding the laminate in a manner described above. Alternatively, the three web layers may be made individually, collected in rolls and combined in a separate bonding step.

The substrate may also contain superabsorbent materials. A wide variety of high absorbency materials (also known as superabsorbent materials) are known to those skilled in the art. See, for example, U.S. Pat. No. 4,076,663 issued Feb. 28, 1978 to Masuda et al, U.S. Pat. No. 4,286,082 issued Aug. 25, 1981 to Tsubakimoto et al., U.S. Pat. No. 4,062,817 issued Dec. 13, 1977 to Westerman, and U.S. Pat. No. 4,340,706 issued Jul. 20, 1982 to Obayashi et al. The absorbent capacity of such high-absorbency materials is generally many times greater than the absorbent capacity of fibrous materials. For example, a fibrous matrix of wood pulp fluff can absorb about 7-9 grams of a liquid, (such as 0.9 weight percent saline) per gram of wood pulp fluff, while the high-absorbency materials can absorb at least about 15, preferably at least about 20, and often at least about 25 grams of liquid, such as 0.9 weight percent saline, per gram of the high-absorbency material. U.S. Pat. No. 5,601,542, issued to Melius et al., discloses an absorbent article in which superabsorbent material is contained in layers of discrete pouches. Alternately, the superabsorbent material may be within one layer or dispersed throughout the substrate.

Cleaning Implement

In an embodiment of the invention, the cleaning composition may be used with a cleaning implement. In an embodiment of the invention, the cleaning implement comprises the tool assembly disclosed in Co-pending application Ser. No. 10/678,033, entitled "Cleaning Tool with Gripping Assembly for a Disposable Scrubbing Head", filed Sep. 30, 2003. In another embodiment of the invention, the cleaning implement comprises the tool assembly disclosed in Co-pending application Ser. No. 10/602,478, entitled "Cleaning Tool with Gripping Assembly for a Disposable Scrubbing Head", filed Jun. 23, 2003. In another embodiment of the invention, the cleaning implement comprises the tool assembly disclosed in Co-pending application Ser. No. 10/766,179, entitled "Interchangeable Tool Heads", filed Jan. 27, 2004. In another embodiment of the invention, the cleaning implement comprises the tool assembly disclosed in Co-pending application Ser. No. 10/817,606, entitled "Ergonomic Cleaning Pad", filed Apr. 1, 2004. In another embodiment of the invention, the cleaning implement comprises the tool assembly disclosed in Co-pending application Ser. No. 10/850,213, entitled "Locking, Segmented Cleaning Implement Handle", filed May 19, 2004.

Wipes Dispenser System

Suitable wipes dispenser systems include both individually packaged disinfectant wipes and bulk packaged one or more disinfectant wipes or other suitable disinfecting articles. The dispenser system suitably comprises a sealable container, which is substantially impervious to both liquid and/or gas. The term "container", refers to, but is not limited to, packets containing one or more individual wipes and bulk dispensers, such as canisters, tubs and jars, which dispense one disinfectant wipe at a time, and further feature suitable means to reseal the bulk dispenser between uses to preserve the integrity of the disinfecting articles. One example is a cylindrical canister dispenser that hosts a roll of individual wipes, separated by perforations to permit the tearing off of individual wipes for use. Such dispenser is conveniently gripped by the user and held in position while the user removes a wipe. Suitable dispensers feature a resealable dispensing cap and orifice (See, e.g., Chong, U.S. Pat. No. 6,554,156, of common assignment and incorporated herein by reference thereto) that dispenses individual wipes from a roll and retains the next wipe in a ready-to-dispense position, yet allows sealing of the dispensing cap to close the container against the environment when not in use. A further example, within the scope of the present invention, is to package individual wipes in a non-linked manner, in a dispenser permitting their removal one at a time, as is the case with many wipe/dispenser combinations known in the art.

Wipe dispensers are convenient items that provide moistened sheets or wipes for a variety of uses. Typically, wipes are formulated for specific purposes that include infant wipes, personal care wipes, dishwashing wipes, hard surface treatment wipes, disinfectant wipes, cosmetic or sanitary wipes, hand wipes, wipes used in car cleaning, household or institutional cleaning or maintenance, computer cleaning and maintenance and any other area in which a flexible substrate having a useful liquid treatment composition has application.

Directions for Use

In one embodiment, the directions include wiping the surface clean with the wipe and letting air dry. In one embodiment, the directions include wiping the surface, using enough wipes for the treated surface to remain visibly wet for 30 seconds or 1 minute or 2 minutes or 4 minutes, and letting the surface dry. For highly soiled surfaces, it may be necessary to clean excess dirt first. In one embodiment, the directions include wiping the surface to be disinfected with a wet cleaning wipe and allowing the surface to dry.

EXAMPLES

In Table I, sample formulations of the present invention are presented.

TABLE I

| Cleaning Composition | A | B | C | D | E | F | G |
|---|---|---|---|---|---|---|---|
| C8 to C10 APG | 1.129 | 1.751 | 1.065 | 1.543 | 2.454 | 0.9122 | 0.798 |
| Ethanol | 3.151 | 2.75 | 3.375 | 2.487 | 3.700 | 2.123 | 1.890 |
| Glycerine | 0.111 | | 0.111 | 0.111 | 0.111 | 0.111 | 0.111 |
| Citric Acid | 0.020 | | | 0.025 | 0.050 | 0.172 | 0.061 |
| Anti-Foaming Agent | 0.050 | | | | 0.075 | 0.025 | 0.563 |
| Preservative | 0.200 | | | | 0.250 | 0.150 | |
| Fragrance | 0.150 | | | | | 0.087 | |
| Water | 95.189 | 95.499 | 95.449 | 95.834 | 93.36 | 96.30 | 96.58 |

Without departing from the spirit and scope of this invention, one of ordinary skill can make various changes and modifications to the invention to adapt it to various usages and conditions. As such, these changes and modifications are properly, equitably, and intended to be, within the full range of equivalence of the following claims.

We claim:

1. A cleaning composition comprising:

a. 0.1 to 5.0 weight % of a C8 to C10 alkylpolyglucoside wherein the alkyl group is substantially C8 alkyl, substantially C10 alkyl, or a mixture of substantially C8 and C10 alkyl;

b. 0.5 to 5.0 weight % of a C2 to C4 alcohol or combination of C2 to C4 alcohols;

c. 0.05 to 2.0 weight % of glycerol; and d. optionally dyes, builders, fatty acids, fragrances, colorants, anti-foaming agent, water-soluble organic acid, and preservatives.

2. The cleaning composition of claim 1, wherein the composition comprises 0.1 to 3.0 weight % of the C8 to C10 alkylpolyglucoside.

3. The cleaning composition of claim 1, wherein the C2 to C4 alcohol or the combination of C2 to C4 alcohols comprise an isopropanol.

4. The cleaning composition of claim 1, wherein the C2 to C4 alcohol or the combination of C2 to C4 alcohols comprise an ethanol.

5. The cleaning composition of claim 1, wherein the composition is loaded onto a substrate.

6. The cleaning composition of claim 1, wherein the composition has a pH of 9.0 or less.

7. A cleaning composition comprising:

a. 0.1 to 5.0 weight % of a C8 to C10 alkylpolyglucoside wherein the alkyl group is substantially C8 alkyl, substantially C10 alkyl, or a mixture of substantially C8 and C10 alkyl;

b. 0.5 to 5.0 weight % of a C2 to C4 alcohol or combination of C2 to C4 alcohols;

c. 0.01 to 5.0 weight % of a water-soluble organic acid;

d. 0.05 to 2.0 weight % of glycerol; and e. optionally dyes, builders, fatty acids, fragrances, colorants, anti-foaming agent, and preservatives.

8. The cleaning composition of claim 7, wherein the water-soluble organic acid is selected from the group consisting of acetic acid, citric acid and formic acid.

9. The cleaning composition of claim 7, wherein the water-soluble organic acid is a 2-hydroxycarboxylic acid.

10. The cleaning composition of claim 7, wherein the composition has a pH of 9.0 or less.

11. The cleaning composition of claim 7, wherein the composition has a pH of 7.0 or less.

12. The cleaning composition of claim 7, wherein the composition is loaded onto a substrate.

13. The cleaning composition of claim 7, wherein the composition comprises 0.1 to 3.0 weight % of the C8 to C10 alkylpolyglucoside.

14. The cleaning composition of claim 7, wherein the C2 to C4 alcohol or the combination of C2 to C4 alcohols comprise an ethanol.

* * * * *